US011407224B2

(12) United States Patent
Kashino

(10) Patent No.: US 11,407,224 B2
(45) Date of Patent: Aug. 9, 2022

(54) LIQUID EJECTING HEAD AND MANUFACTURING METHOD THEREOF

(71) Applicant: CANON KABUSHIKI KAISHA, Tokyo (JP)

(72) Inventor: Toshio Kashino, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 15 days.

(21) Appl. No.: 17/027,114

(22) Filed: Sep. 21, 2020

(65) Prior Publication Data

US 2021/0086510 A1 Mar. 25, 2021

(30) Foreign Application Priority Data

Sep. 25, 2019 (JP) ..... JP2019-173878

(51) Int. Cl.
*B41J 2/14* (2006.01)
*B41J 2/16* (2006.01)

(52) U.S. Cl.
CPC ..... *B41J 2/14072* (2013.01); *B41J 2/1623* (2013.01); *B41J 2202/22* (2013.01)

(58) Field of Classification Search
CPC .. B41J 2/14072; B41J 2/1623; B41J 2202/22; B41J 2/1603; B41J 2/1626; B41J 2/1631; B41J 2/1635; B41J 2/1643
See application file for complete search history.

(56) References Cited

U.S. PATENT DOCUMENTS 6,799,841 B2 10/2004 Iri et al.
7,025,441 B2 4/2006 Kashino et al.
9,248,647 B2 * 2/2016 Iwanaga ..... B41J 2/155
2017/0021622 A1 * 1/2017 Takahashi ..... B41J 2/16

FOREIGN PATENT DOCUMENTS

JP 2001-138520 A 5/2001

OTHER PUBLICATIONS

IP.com search (Year: 2021).*

* cited by examiner

*Primary Examiner* — Lisa Solomon
(74) *Attorney, Agent, or Firm* — Venable LLP

(57) ABSTRACT

In a liquid ejecting head, an electrical connection portion between an element substrate and a wiring substrate can be satisfactorily sealed, and a decrease in yield and an increase in manufacturing cost can be suppressed. The liquid ejecting head includes the element substrate having a plurality of energy generating elements and a plurality of electrodes, and the wiring substrate having a plurality of electrode terminals connected to the plurality of electrodes. The element substrate and the wiring substrate are overlapped with each other in a state where the electrode and the electrode terminal face each other, a connection portion is surrounded by a resin layer, and the resin layer is covered with a sealing resin. The resin layer is divided into a plurality of portions by a gap provided in a portion between both end portions of the electrode terminal in an arrangement direction. An inside of the gap is filled with the sealing resin.

7 Claims, 15 Drawing Sheets

LIQUID EJECTING HEAD AND MANUFACTURING METHOD THEREOF

BACKGROUND OF THE INVENTION

Field of the Invention

The present invention relates to a liquid ejecting head and a manufacturing method thereof.

Description of the Related Art

A liquid ejecting head for ejecting liquid to perform recording normally has an element substrate provided with an energy generating element for generating ejection energy and an electrode electrically connected to the energy generating element. A wiring substrate including an electrode terminal connected to the electrode of the element substrate and transmitting an electric signal supplied to the energy generating element is bonded to the element substrate. The electrode of the wiring substrate and the electrode terminal of the element substrate are connected using one of an anisotropic conductive film (ACF) and a gold bump formed on the electrode. A connection portion via the bump is protected by one of a non-conductive film (NCF) and a non-conductive paste (NCP). However, although ACF, NCF, and NCP protect the connection portion from moisture such as humidity, ACF, NCF, and NCP have poor resistance to liquid ink. Therefore, it is necessary to cover the periphery of the connection portion with a sealing resin having ink resistance. A gap between the wiring substrate and the element substrate is approximately 30 μm in the bonding using ACF and approximately 60 μm in the bonding using the bump. An underfill material is normally used as the sealing resin that fills this gap.

Japanese Patent Application Laid-Open No. 2001-138520 discloses a configuration in which the electrode terminals of the wiring substrate are disposed at positions retracted only by 0.05 mm to 1.0 mm from the end portions of the wiring substrate. With this configuration, the gap between the wiring substrate and the element substrate on the end portion side from the electrode terminal is able to be filled with the sealing resin using the capillary force to seal the connection portion.

Normally, the end surface of the wiring substrate connected to the element substrate of the liquid ejecting head is located in the vicinity of the ejection orifice for ejecting the liquid, and it is difficult to directly apply the underfill material from the end surface. Therefore, the underfill material is applied to the surface in the vicinity of the end portion of the wiring substrate on the side opposite to the connection portion, and the underfill material is caused to be turned around the gap between the element substrate and the wiring substrate through the end portion of the wiring substrate by the capillary force. However, when the liquid ejecting head is larger and finer, there is a problem in that the connection portion is large, and the underfill material that turns around the end portion of the wiring substrate does not sufficiently fill the entire area of the gap between the element substrate and the wiring substrate. In addition, the problem may occur that the underfill material enters the gap while taking in the air bubbles. When these problems occur, the yield and the productivity are reduced, which is a factor of increasing the manufacturing cost.

Therefore, an object of the present invention is to provide a liquid ejecting head capable of satisfactorily sealing an electrical connection portion between an element substrate and a wiring substrate, and a manufacturing method thereof.

SUMMARY OF THE INVENTION

According to the present invention, there is provided a liquid ejecting head comprising an element substrate that includes a plurality of energy generating elements generating energy for ejecting a liquid, and a plurality of electrodes connected to the plurality of energy generating elements, and a wiring substrate that includes a plurality of electrode terminals connected to the plurality of electrodes, in which the plurality of electrodes and the plurality of electrode terminals are arranged side by side in a row, respectively, the element substrate and the wiring substrate are overlapped each other in a state where the electrode and the electrode terminal face each other, a connection portion to which the plurality of electrodes and the plurality of electrode terminals are connected is surrounded by a resin layer, and the resin layer is covered with a sealing resin, the resin layer is divided into a plurality of portions by a gap provided in a portion between both end portions in an arrangement direction of the electrode terminals, and an inside of the gap of the resin layer is filled with the sealing resin.

Further features of the present invention will become apparent from the following description of exemplary embodiments with reference to the attached drawings.

DESCRIPTION OF THE EMBODIMENTS

Hereinafter, embodiments of the present invention will be described.

Figure 1A:
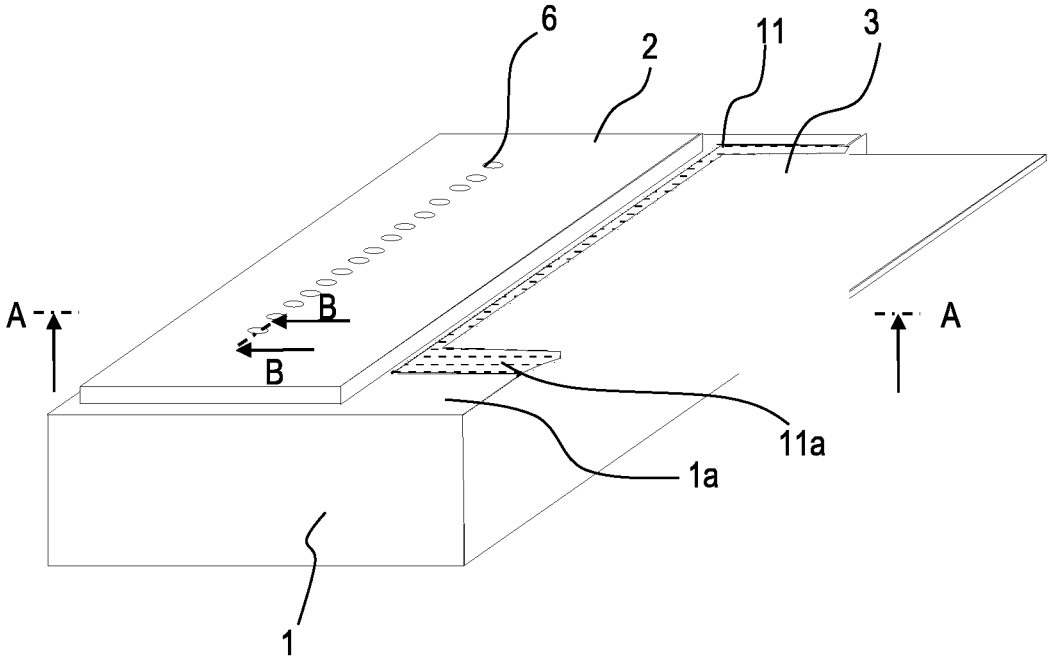
FIG. 1A is a perspective view of a liquid ejecting head according to an embodiment of the present invention.
Figure 1B:
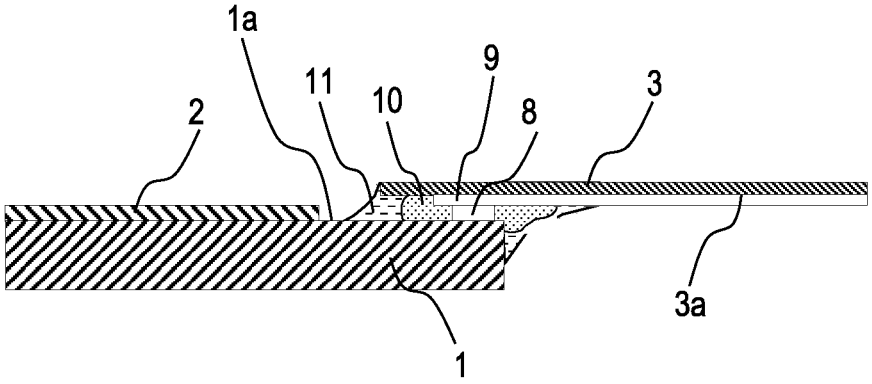
FIG. 1B is a cross-sectional view taken along the line A-A of the liquid ejecting head according to the embodiment of the present invention.
Figure 2:
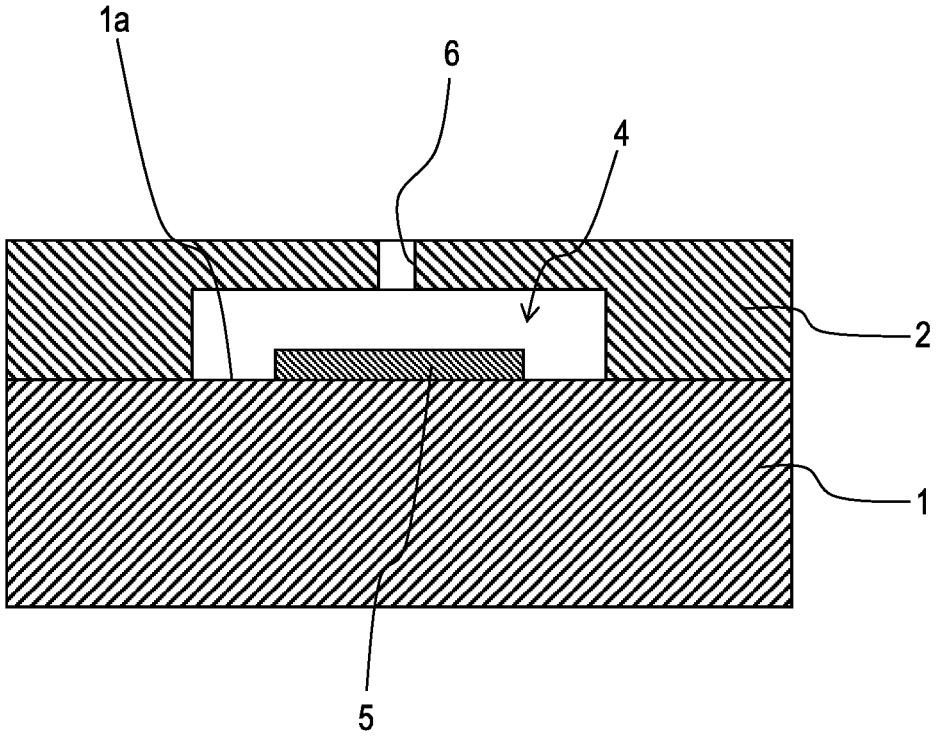
FIG. 2 is a cross-sectional view taken along the line B-B of a main part of the liquid ejecting head illustrated in FIG. 1A.

FIG. 1A is a perspective view of a liquid ejecting head according to an embodiment of the present invention, and FIG. 1B is a cross-sectional view taken along the line A-A thereof. FIG. 2 is an enlarged cross-sectional view taken along the line B-B of the liquid ejecting head, illustrating the vicinity of the ejection orifice. In each drawing, the A-A line illustrates a cutting line along a longitudinal direction of the wiring substrate, and the B-B line illustrates a cutting line along a width direction of the wiring substrate. In the liquid ejecting head according to the present embodiment, an ejection orifice forming member 2 is laminated on one surface 1*a* of an element substrate 1 and one side portion of a wiring substrate 3 is fixed to one surface 1*a* of the element substrate 1. The ejection orifice forming member 2 and the wiring substrate 3 are disposed with an interval therebetween. As schematically illustrated in FIG. 2, a plurality of pressure chambers 4 is formed between the ejection orifice forming member 2 and the element substrate 1. An energy generating element 5 located inside each pressure chamber 4 and a wiring (not illustrated) electrically connected to the energy generating element 5 are formed on the one surface 1*a* of the element substrate 1. Examples of the energy generating element 5 include a heating resistor and a piezoelectric element. The ejection orifice forming member 2 is formed with an ejection orifice 6 that opens from the pressure chamber 4 to the outside.

In this liquid ejecting head, liquid is supplied to the pressure chamber 4 from a flow path (not illustrated). When an electric signal is supplied from the wiring substrate 3 to the energy generating element 5 via the wiring on the element substrate 1, the energy generating element 5 is driven to generate energy for ejecting the liquid. For example, in a case where the energy generating element 5 is a heating resistor, heat energy is generated, and heat energy is applied to the liquid in the pressure chamber 4 to heat and foam the liquid. The liquid is ejected from the ejection orifice 6 to the outside by the foaming pressure.

Figure 3A:
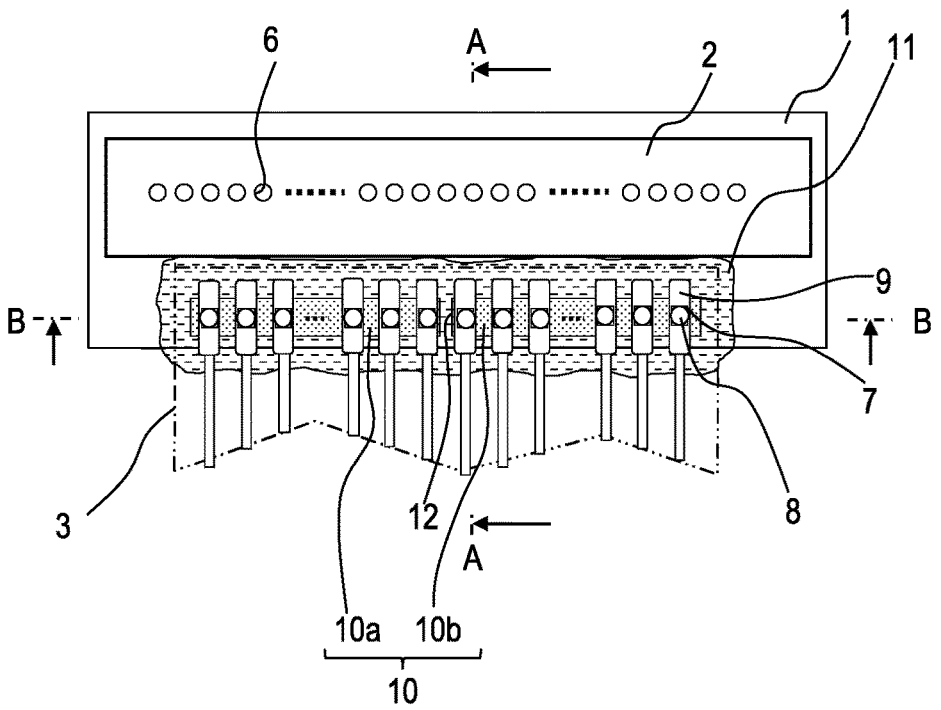
FIG. 3A is a plan view illustrating a wiring substrate in a portion where an element substrate and the wiring substrate are bonded in the liquid ejecting head illustrated in FIGS. 1A and 1B.
Figure 3B:
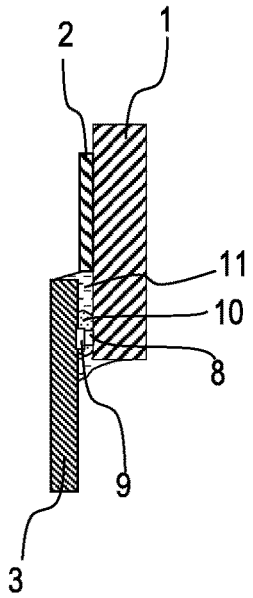
FIG. 3B is a cross-sectional view taken along the line A-A of the portion where the element substrate and the wiring substrate are bonded in the liquid ejecting head illustrated in FIGS. 1A and 1B.
Figure 3C:
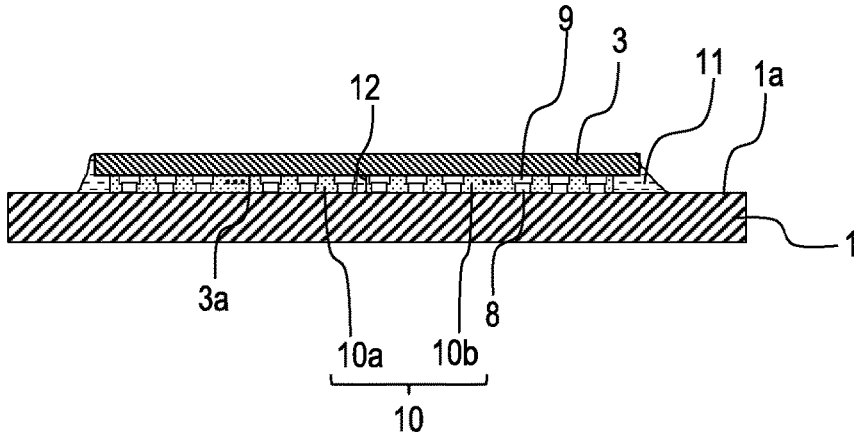
FIG. 3C is a cross-sectional view taken along the line B-B of the portion where the element substrate and the wiring substrate are bonded in the liquid ejecting head illustrated in FIGS. 1A and 1B.

The connection portion between the element substrate 1 and the wiring substrate 3 of this liquid ejecting head will be described. FIG. 3A is a plan view illustrating a perspective view of the wiring substrate 3 illustrated by a two-dot chain line in a portion where the element substrate 1 and the wiring substrate 3 are bonded, FIG. 3B is a cross-sectional view taken along the line A-A thereof, and FIG. 3C is a cross-sectional view taken along the line B-B. A plurality of electrodes 7 is arranged side by side in a row on the one surface 1*a* of the element substrate 1 in the vicinity of an outer peripheral portion and at a position not overlapping the ejection orifice forming member 2. The plurality of electrodes 7 is connected to the energy generating element 5 (refer to FIG. 2) via wiring (not illustrated). In the illustrated example, a gold bump 8 is provided on the electrode 7. On the other hand, a plurality of electrode terminals 9 is provided on a facing surface 3*a* of the wiring substrate 3 facing the one surface 1*a* of the element substrate 1. The plurality of electrode terminals 9 is arranged side by side so as to form a row, and are located at positions that can face each of the plurality of electrodes 7 of the element substrate 1. The facing surface 3*a* of the wiring substrate 3 is overlapped on the one surface 1*a* of the element substrate 1, and each of the bumps 8 on the electrode 7 is in contact with each of the electrode terminals 9. The connection portion between the electrode 7, the bump 8 and the electrode terminal 9 is surrounded by a resin layer 10. The outside of the resin layer 10 is further sealed with a sealing resin 11. The resin layer 10 surrounding the connection portion between the electrode 7, the bump 8 and the electrode terminal 9 is made of NCF, for example. The sealing resin 11 is made of an underfill material, and has, for example, an epoxy resin as a main component. The resin layer 10 is divided into a plurality of portions 10*a* and 10*b* by a gap 12. In other words, instead of surrounding the entire connection portion between the electrode 7, the bump 8 and the electrode terminal 9 by the continuous integral resin layer, the connection portion is surrounded by the plurality of portions 10*a* and 10*b* of the resin layer 10, and the gap 12 is provided between adjacent portions of the resin layer 10. The sealing resin 11 that is located outside the resin layer 10 and seals also enters the inside of the gap 12.

According to this structure, the connection portion between the electrode 7, the bump 8 and the electrode terminal 9 is surrounded by the resin layer 10 and protected so as not to come into contact with moisture such as humidity. Furthermore, the resin layer 10 sealed by the sealing resin 11 is protected so as not to come into contact with the liquid to be ejected (for example, liquid ink). The sealing resin 11 is sufficiently filled to protect the connection portion and the resin layer 10, and realizes good sealing without causing insufficient filling and generation of internal voids. In this manner, since insufficient filling and voids do not occur, the manufacturing yield increases and the manufacturing cost can be kept low. In addition, since the liquid ejecting head with high precision is able to favorably eject the liquid, it is possible to perform recording with high recording quality and reliability.

Figure 4A:
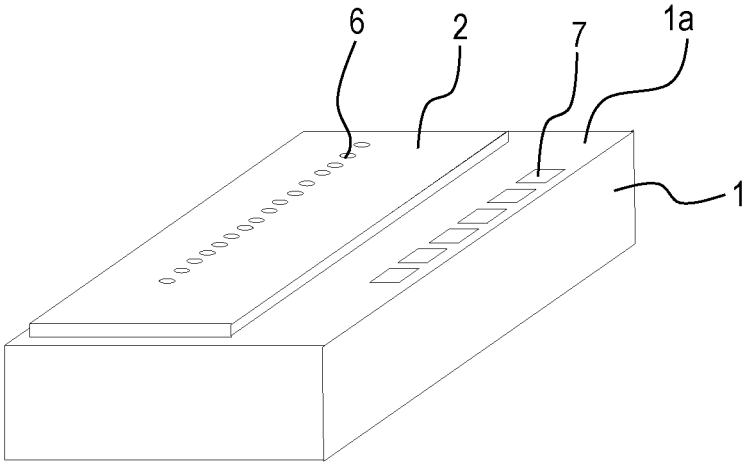
FIG. 4A is a perspective view illustrating a state where the element substrate and an ejection orifice forming member are bonded in a manufacturing method of the liquid ejecting head illustrated in FIGS. 1A and 1B.
Figure 4B:
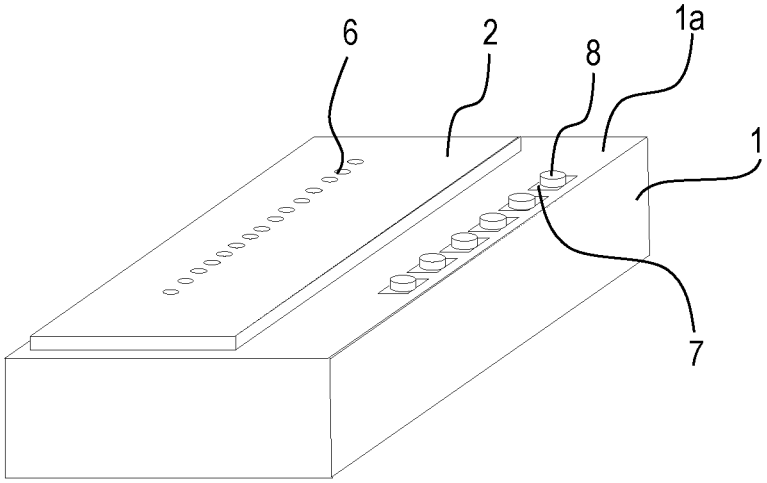
FIG. 4B is a perspective view illustrating the state where the element substrate and the ejection orifice forming member are bonded in the manufacturing method of the liquid ejecting head illustrated in FIGS. 1A and 1B.
Figure 5A:
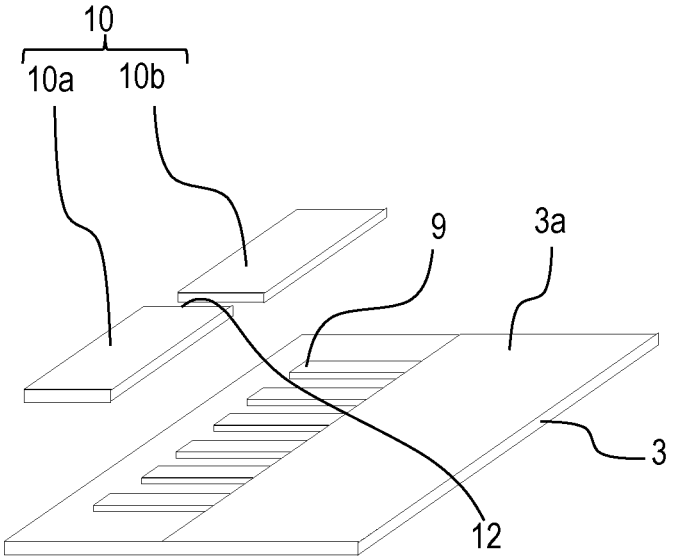
FIG. 5A is a perspective view illustrating a step of forming the wiring substrate in the manufacturing method of the liquid ejecting head illustrated in FIGS. 1A and 1B.
Figure 5B:
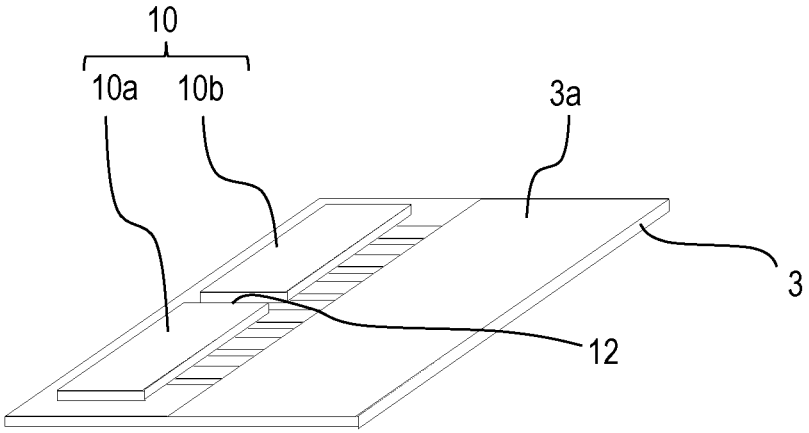
FIG. 5B is a perspective view illustrating the step of forming the wiring substrate in the manufacturing method of the liquid ejecting head illustrated in FIGS. 1A and 1B.

A manufacturing method of the liquid ejecting head according to the present embodiment will be described. FIGS. 4A and 4B illustrate the element substrate 1 and the ejection orifice forming member 2 before the wiring substrate is bonded. FIGS. 5A and 5B illustrate the wiring substrate 3 before being bonded to the element substrate 1. FIGS. 6A to 6C and 7A to 7C illustrate a state where the element substrate 1, the ejection orifice forming member 2 and the wiring substrate 3 are bonded to each other.

First, the energy generating element 5 (refer to FIG. 2) such as a heating resistor and the wiring (not illustrated) are patterned by photolithography technique on the one surface 1*a* of the element substrate 1 made of a silicon wafer. The ejection orifice forming member 2 is formed of a photosensitive resin on the one surface 1*a* of the element substrate 1 on which the energy generating element 5 and the wiring are patterned. The ejection orifice forming member 2 is formed with a recessed portion or a partition wall for forming the pressure chamber 4 and the flow path. Furthermore, the ejection orifice 6 communicating with the pressure chamber 4 is formed in the ejection orifice forming member 2. Thereafter, a liquid supply port (not illustrated) is formed on the other surface 1*b* side of the element substrate by anisotropic etching. Furthermore, as illustrated in FIG. 4A, the plurality of electrodes 7 is formed by plating patterning on the one surface 1*a* of the element substrate 1 in the vicinity of one side portion when viewed in a plan view. The plurality of electrodes 7 is arranged in parallel with the side surface of the element substrate 1. Thereafter, as illustrated in FIG. 4B, the gold bump (stud bump) 8 is formed on the electrodes 7 by wire bonding. The height of the bump 8 according to the present embodiment is in the range of 0.02 mm to 0.05 mm.

Figure 7A:
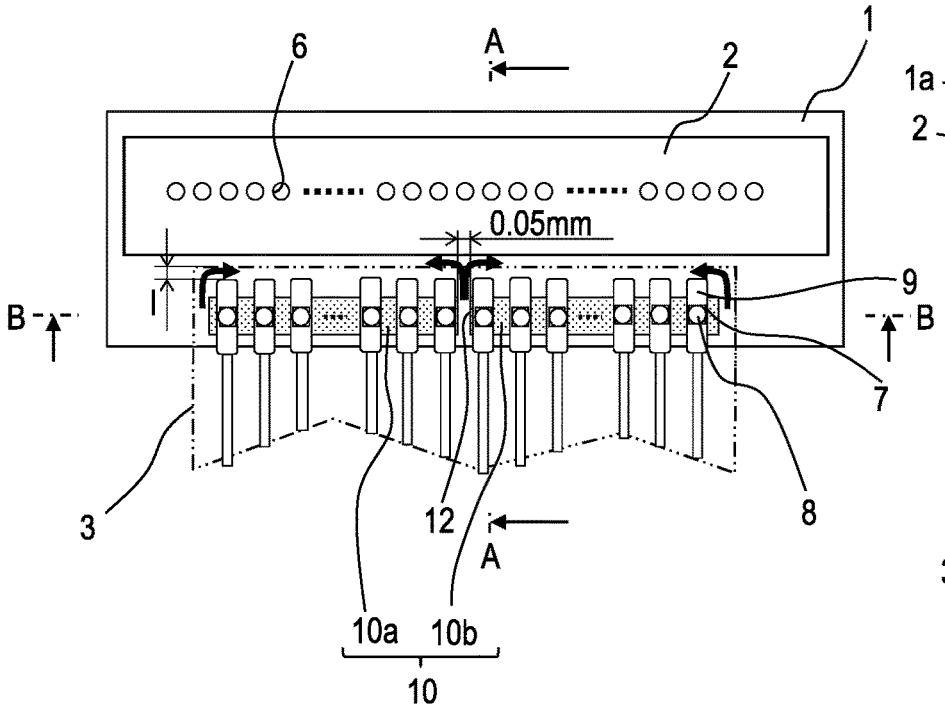
FIG. 7A is a plan view illustrating the wiring substrate in the portion where the element substrate and the wiring substrate are bonded in the manufacturing method of the liquid ejecting head illustrated in FIGS. 1A and 1B.

On the other hand, as illustrated in FIGS. 5A and 5B, the wiring substrate 3 for supplying an electric signal to the element substrate 1 is prepared. The plurality of electrode terminals 9 is formed in the vicinity of one side portion of the wiring substrate 3 when viewed in a plan view. The electrode terminals 9 are provided in the same number as that of the electrodes 7 of the element substrate 1, and each of the electrode terminals 9 is disposed so as to face a corresponding one of the electrodes 7. Therefore, the electrode terminals 9 have the same planar shape and size as that of the electrodes 7, and are arranged at the same pitch. As illustrated in FIG. 7A, the electrode terminal 9 is disposed at a position retracted from the end portion of the wiring substrate 3 by a distance 1 when viewed in a plan view. In the present embodiment, the distance 1 is in the range of 0.05 mm to 1.0 mm. Next, as illustrated in FIG. 5B, NCF that is the resin layer 10 is temporarily pressure-bonded to the wiring substrate 3 at the position where the electrode terminal 9 is provided. The resin layer 10 includes a plurality of (two in the illustrated example) portions 10*a* and 10*b* divided by the gap 12.

Figure 6A:
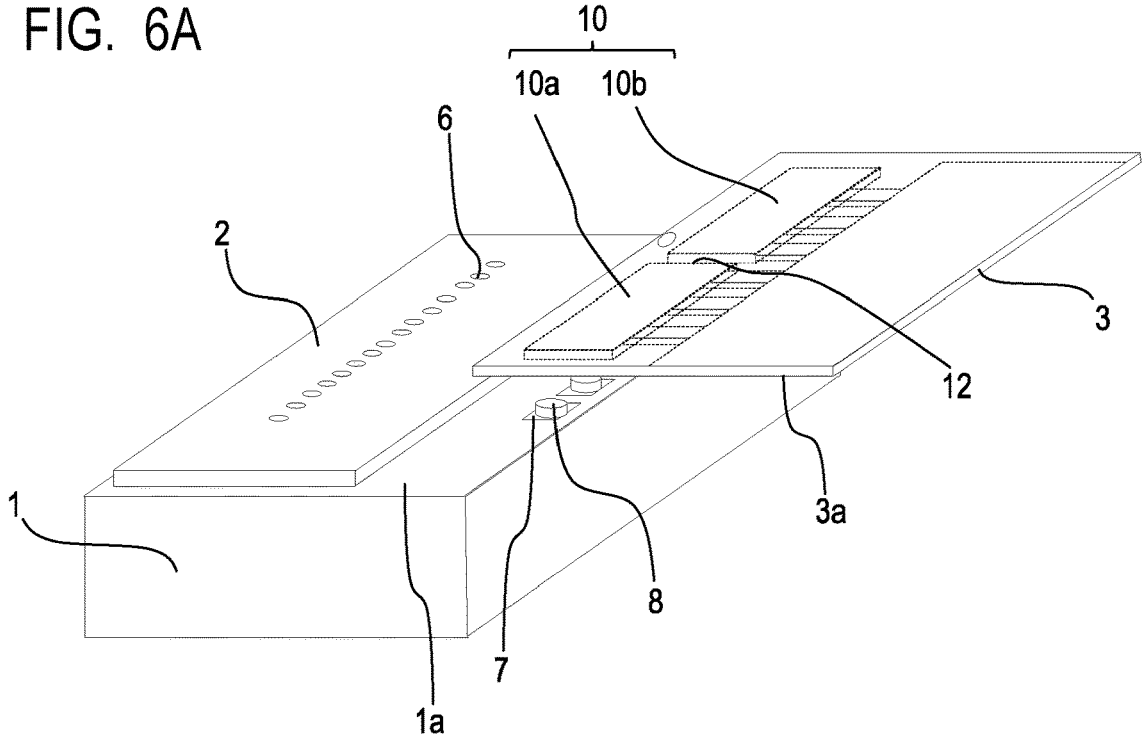
FIG. 6A is a perspective view illustrating a step of bonding the element substrate and the wiring substrate in the manufacturing method of the liquid ejecting head illustrated in FIGS. 1A and 1B.
Figure 6B:
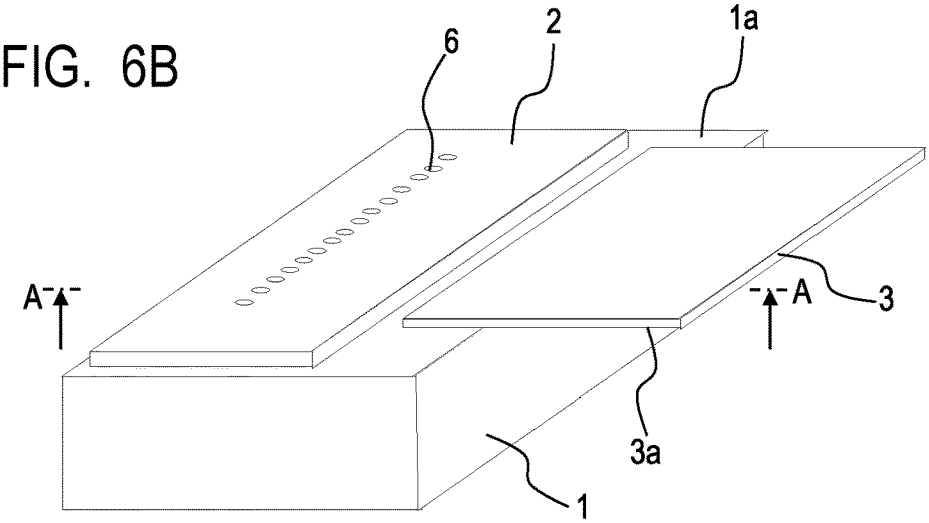
FIG. 6B is a perspective view illustrating the step of bonding the element substrate and the wiring substrate in the manufacturing method of the liquid ejecting head illustrated in FIGS. 1A and 1B.
Figure 6C:
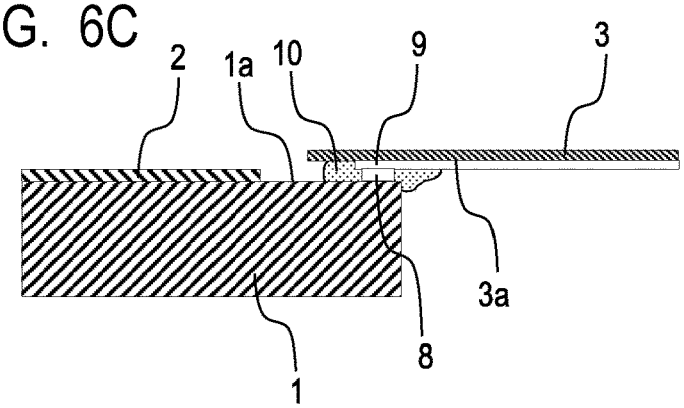
FIG. 6C is a cross-sectional view taken along the line A-A illustrating the step of bonding the element substrate and the wiring substrate in the manufacturing method of the liquid ejecting head illustrated in FIGS. 1A and 1B.

The electrodes 7 and the electrode terminals 9 are aligned so as to face each other via the bump 8 and the NCF 10, and the wiring substrate 3 is disposed on the one surface 1*a* of the element substrate 1 as illustrated in FIGS. 6A to 6C. The element substrate 1 and the wiring substrate 3 are pressed and pressure-bonded. The electrode terminal 9 is retracted from the end portion of the wiring substrate 3 by a distance 1=0.05 mm to 1.0 mm. Therefore, as illustrated in FIGS. 6C and 7A to 7C, even when the resin layer 10 spreads by the thermocompression bonding between the element substrate 1 and the wiring substrate 3, it is possible to prevent the resin layer 10 from protruding to the outside from the end portion of the wiring substrate 3. In the case of bonding by NCF via the bump 8 as in the present embodiment, a gap of approximately 60 μm is able to be ensured between the wiring substrate 3 and the element substrate 1.

Figure 8A:
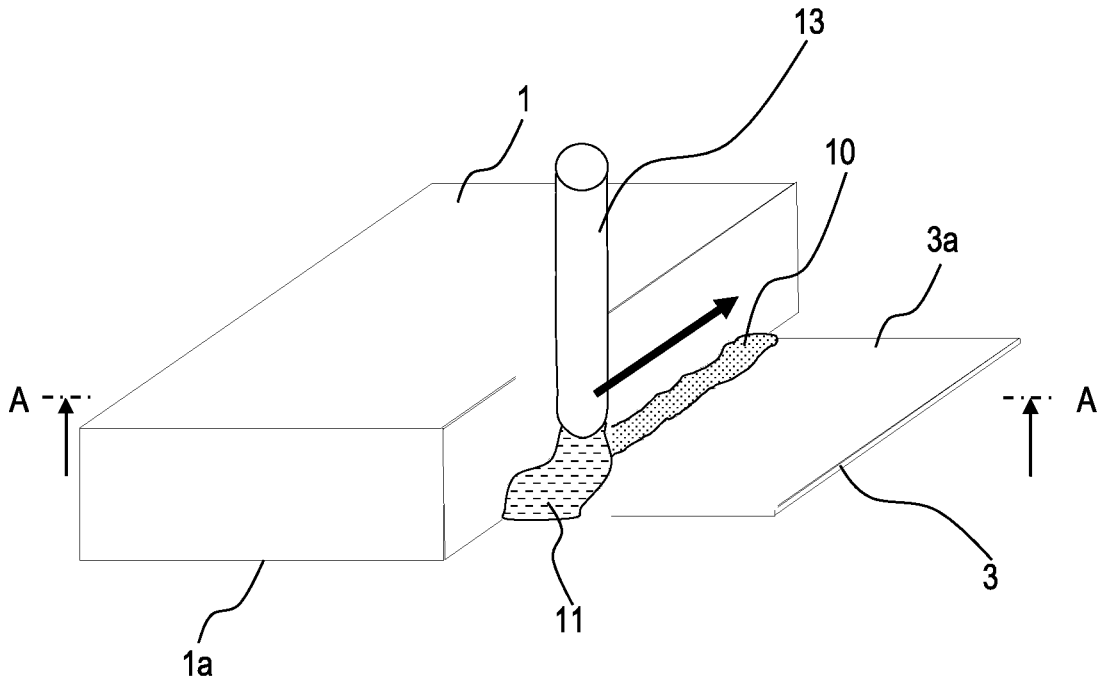
FIG. 8A a perspective view illustrating a step of applying a sealing resin in the manufacturing method of the liquid ejecting head illustrated in FIGS. 1A and 1B.
Figure 8B:
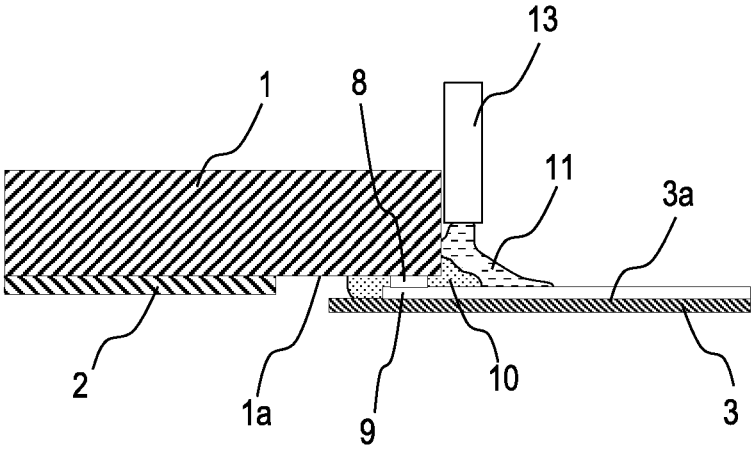
FIG. 8B is a cross-sectional view taken along the line A-A illustrating the step of applying the sealing resin in the manufacturing method of the liquid ejecting head illustrated in FIGS. 1A and 1B.

After the wiring substrate 3 is bonded to the one surface 1*a* of the element substrate 1 in this manner, the sealing resin 11 is applied as illustrated in FIGS. 8A and 8B. FIG. 8A is a perspective view of a state where the sealing resin is applied, and FIG. 8B is a cross-sectional view taken along the line A-A thereof. Specifically, a laminated body of the element substrate 1, the ejection orifice forming member 2 and the wiring substrate 3 is disposed so that the element substrate 1 faces upward, and a needle 13 of a liquid quantitative applying device is disposed so that a tip end portion is located on the wiring substrate 3 and at a position close to the side wall of the element substrate 1. While moving the needle 13 in the direction of the arrow in FIG. 8A, a fixed amount of the sealing resin 11 is continuously ejected from the opening at the tip end of the needle 13 and applied so as to cover the resin layer 10. The sealing resin 11 spreads so as to cover the resin layer 10 and enters the gap 12 (refer to FIG. 7A) of the resin layer 10. After passing through the gap, the sealing resin 11 entered the gap 12 spreads left and right from the inner side to the outer side in the arrangement direction of the electrode terminals 9 (the same direction as the arrangement direction of the electrodes 7) to cover each of the portions 10*a* and 10*b* of the resin layer 10. As a result, the liquid ejecting head illustrated in FIGS. 1A and 1B is formed.

In the present embodiment, the sealing resin 11 sufficiently covers the entire resin layer 10 surrounding the connection portion between the electrode 7 of the element substrate 1 and the electrode terminal 9 of the wiring substrate 3, and is prevented from forming an uncovered portion and forming voids due to taking in the air bubbles. Therefore, in the present embodiment, the gap 12 is provided at an intermediate portion (part) between both end portions of the resin layer 10 surrounding the connection portion in the arrangement direction of the electrode terminals 9 to divide the resin layer 10 into the plurality of portions 10*a* and 10*b*. The width of this gap is preferably 0.05 mm to 0.5 mm and has a sufficient size so that the gap 12 does not collapse and disappear, even when the resin layer 10 is pressed and spread at the time of bonding the element substrate 1 and the wiring substrate 3. The gap 12 has a function of promoting the inflow of the sealing resin 11. That is, the sealing resin 11 not only turns around from both side portions of the wiring substrate by capillary action and is filled, but also progresses by capillary action from the intermediate portion to both side portions in the arrangement direction of the electrode terminals 9. Therefore, the sealing resin 11 is filled so as to cover the entire connection portion and the resin layer 10. Since the sufficient amount of the sealing resin 11 is smoothly filled, it is possible to prevent the sealing resin 11 from taking in the air bubbles. The width of the gap 12 is determined according to the viscosity of the sealing resin 11 and the size of the gap between the element substrate 1 and the wiring substrate 3. When the viscosity of the sealing resin 11 is 10 Pa·sec or less, and the width of the gap 12 is 0.03 mm or more, the sealing resin 11 can be sufficiently filled.

It is desirable that the sealing resin 11 is a highly fluid one such as a flip chip underfill material used for bare chip mounting. For example, when a flip chip underfill material containing an epoxy resin as a main component is applied to a predetermined position in the vicinity of the connection portion between the wiring substrate 3 and the element substrate 1, and thereafter heated to, for example, 40° C. to 90° C. and stood for approximately 3 minutes to 10 minutes, the entire area of the connection portion and the resin layer 10 is filled. As a result, a fillet 11*a* illustrated in FIG. 1A is formed on the outer circumference. Thereafter, by heating at 120° C. to 150° C. and curing, good sealing with the sealing resin 11 is able to be performed in a short time.

In addition, in the present embodiment, since the sealing resin 11 is accommodated and filled in the lower side (facing surface 3*a*) of the wiring substrate 3, a projection portion due to the sealing resin 11 does not occur on the upper side of the wiring substrate 3. As a result, when the liquid ejecting head is mounted on the recording apparatus, an interval between the liquid ejecting head and the recording medium is able to be set small, and the recording accuracy is able to be improved. In addition, since there are few irregularities on the ejection orifice side of the liquid ejecting head, it is possible to satisfactorily perform cleaning using a wiping blade.

In the above description, as illustrated in FIGS. 4A and 4B, the ejection orifice forming member 2 is bonded and the electrodes 7 and the bump 8 are formed on each of the element substrates 1. However, the ejection orifice forming member 2 is bonded and the electrodes 7 and the bump 8 are formed on the plurality of locations on a large-area silicon wafer, and thereafter the silicon wafer may be cut by a dicing device to be divided into each of the element substrates 1.

In the above-described example, although the gold bump (ball electrode) 8 is formed on the electrode 7 of the element substrate 1, is brought into contact with the electrode terminal 9 of the wiring substrate 3, and is surrounded by the resin layer 10 made of NCF to be bonded, the configuration is not limited to this configuration. For example, the bump 8 may not be formed, and instead, the ACF that is the resin layer 10 is able to be temporarily pressure-bonded to the portion where the electrode terminal 9 of the wiring substrate 3 is formed. In that case, the resin layer 10 made of ACF is faced to the element substrate 1, and the electrodes 7 and the electrode terminals 9 are aligned and brought into direct contact with each other, and are heated to be pressure-bonded, so that the element substrate 1 and the wiring substrate 3 are able to be fixed to each other. In addition, the resin layer 10 is not limited to NCF, and NCP applied to the portion where the electrode terminals 9 of the wiring substrate 3 are formed is able to be used as the resin layer 10. Also in this case, the resin layer 10 made of NCP is faced to the element substrate 1 and the electrodes 7 and the electrode terminals 9 are aligned and heated to be pressure-bonded, so that the element substrate 1 and the wiring substrate 3 are able to be fixed to each other. In the present embodiment, since the electrode terminal 9 is located at the position retracted from the end portion of the wiring substrate 3 by the distance 1=0.05 mm to 1.0 mm, it is possible to prevent the resin layer 10 spread by the thermocompression bonding between the element substrate 1 and the wiring substrate 3 from protruding from the end portion of the wiring substrate 3 to the outside. In the case of bonding by one of NCF and NCP via the bump 8, a gap of approximately 60 μm is able to be ensured between the wiring substrate 3 and the element substrate 1. In addition, in a case where the ACF bonding is performed without providing the bump 8, a gap of approximately 30 μm is able to be ensured between the wiring substrate 3 and the element substrate 1.

EXAMPLE

Hereinafter, more specific examples of the liquid ejecting head according to the present invention will be described in comparison with a comparative example. Part of the description of the same parts as those in the embodiment of the present invention will be omitted.

Comparative Example

Figure 9A:
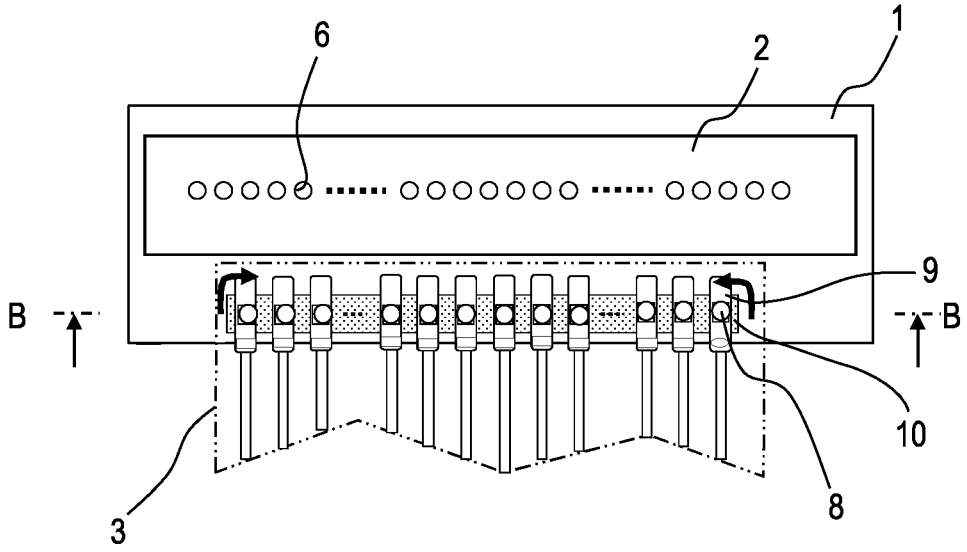
FIG. 9A is a plan view illustrating a wiring substrate in a portion where an element substrate and the wiring substrate are bonded in a liquid ejecting head according to a comparative example.
Figure 9B:
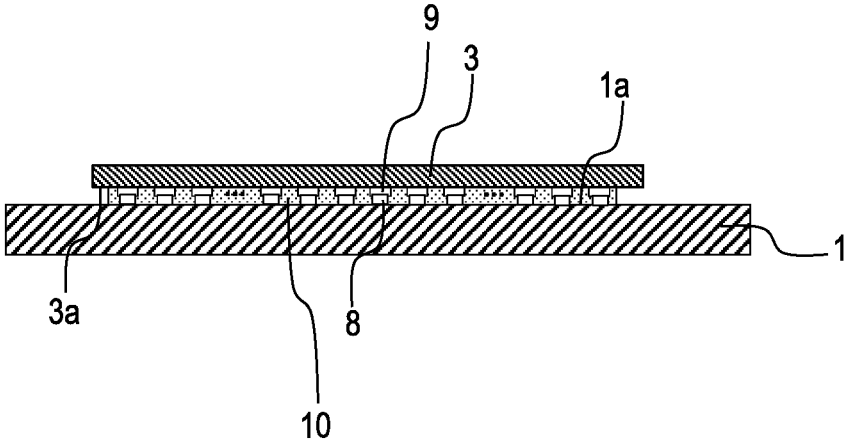
FIG. 9B is a cross-sectional view taken along the line B-B of the wiring substrate in the portion where the element substrate and the wiring substrate are bonded in the liquid ejecting head according to the comparative example.
Figure 10A:
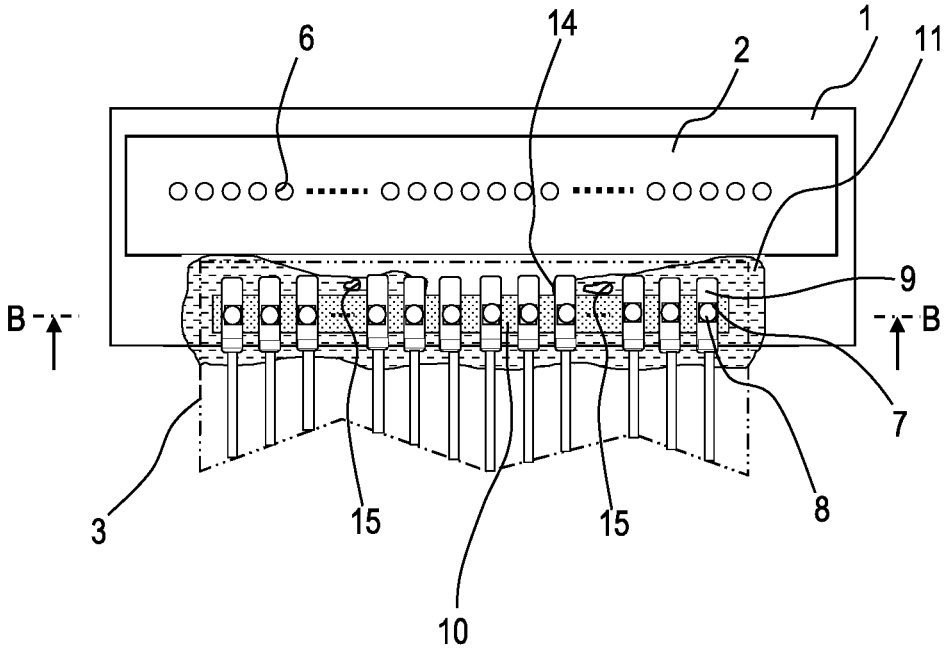
FIG. 10A is a plan view illustrating the wiring substrate in a state where a sealing resin is applied to the liquid ejecting head illustrated in FIGS. 9A and 9B.
Figure 10B:
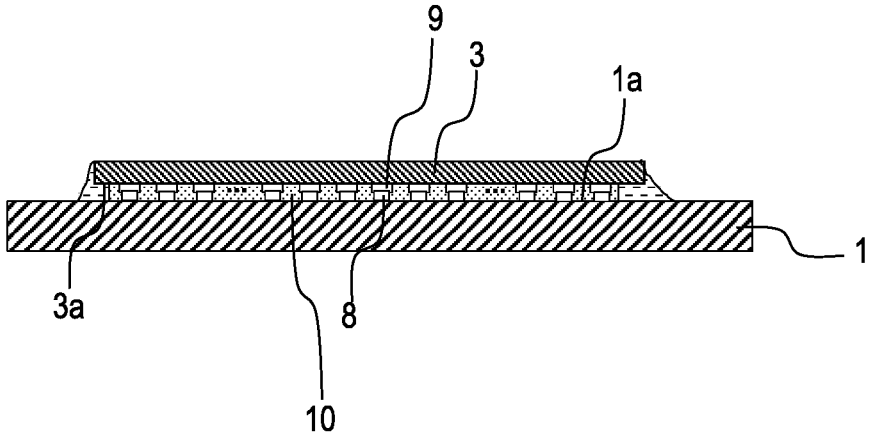
FIG. 10B is a cross-sectional view taken along the line B-B of the wiring substrate in a state where the sealing resin is applied to the liquid ejecting head illustrated in FIGS. 9A and 9B.

FIG. 9A illustrates a plan view illustrating a perspective view of a wiring substrate 3 illustrated by a two-dot chain line in a portion where an element substrate 1 and the wiring substrate 3 are bonded in a liquid ejecting head according to a comparative example having the same configuration as that in the related art. FIG. 9B is a cross-sectional view taken along the line B-B thereof. FIG. 10A is a plan view illustrating a perspective view of the wiring substrate in a state where a sealing resin is applied to the liquid ejecting head illustrated in FIGS. 9A and 9B, and FIG. 10B is a cross-sectional view taken along the line B-B thereof. In the liquid ejecting head according to the present comparative example, 70 electrode terminals 9 are provided on the wiring substrate 3 having a width of 15 mm. The electrode terminals 9 are arranged side by side in a row at a position retracted 0.2 mm from the end portion of the wiring substrate 3. In the present comparative example, the resin layer 10 is not provided with the gap 12. Since the sealing resin 11 covering the resin layer 10 only turns around from both end portions of the wiring substrate 3, there is a possibility that the sealing resin 11 may not be sufficiently supplied to the intermediate portion in the arrangement direction of the electrode terminals 9. Even when an underfill material CV5350AS (trade name) manufactured by Panasonic Corporation having a viscosity of 4 Pa·sec is used as the sealing resin 11 and is heated to 40° C. to 90° C. after applying to temporarily increase the fluidity, it is difficult to be turned around the entire area of the resin layer 10. There is a possibility that curing starts in the middle of the flow of the sealing resin 11, a region 14 that does not turn around is generated, and a void 15 is created due to taking in the air bubbles. On the other hand, when an attempt is made to increase the applying amount of the sealing resin 11, the resin is excessively collected at both ends of the wiring substrate 3, and the problem of flowing to the ejection orifice forming member 2 and closing the ejection orifice 6 occurs prior to turning around a periphery of the resin layer 10. As a result, in the present comparative example, there is a possibility that the resin layer 10 is able not to be easily and reliably covered with the sealing resin 11 satisfactorily.

Example 1

Example 1 of the present invention based on the above-described embodiment will be described with reference to FIGS. 1A, 1B, and 7A to 7C. In the present example, the wiring substrate 3 having a width of 15 mm and having 70 electrode terminals 9 arranged at a position retracted by 0.2 mm from the end portion is used. The resin layer 10 of the wiring substrate 3 is made of NCF, and is divided into two portions 10*a* and 10*b* by a gap 12 having a width of 0.05 mm at an intermediate portion in the arrangement direction of the electrode terminals 9. Even after the resin layer 10 is spread by thermocompression bonding of the element substrate 1 and the wiring substrate 3, the gap 12 is ensured and the width thereof is 0.03 mm or more. The electrodes 7 of the element substrate 1 are disposed so as to overlap the electrode terminals 9 of the wiring substrate 3. In the present example, an underfill material CV5350AS (trade name) manufactured by Panasonic Corporation having a viscosity of 4 Pa·sec is used as the sealing resin 11. After thermocompression bonding the element substrate 1 and the wiring substrate 3 in the same manner as in the above-described embodiment, the sealing resin 11 was applied and allowed to stand for 10 minutes while being heated to 60° C., so that the entire area of the connection portion and the resin layer 10 was spread with the sealing resin 11. Thereafter, the element substrate 1 and the wiring substrate 3 were heated to 150° C. and stood for 30 minutes to cure the sealing resin 11 to form the liquid ejecting head illustrated in FIGS. 1A and 1B.

Figure 7B:
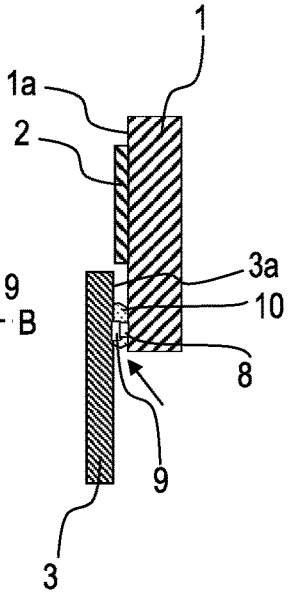
FIG. 7B is a cross-sectional view taken along the line A-A of the portion where the element substrate and the wiring substrate are bonded in the manufacturing method of the liquid ejecting head illustrated in FIGS. 1A and 1B.
Figure 7C:
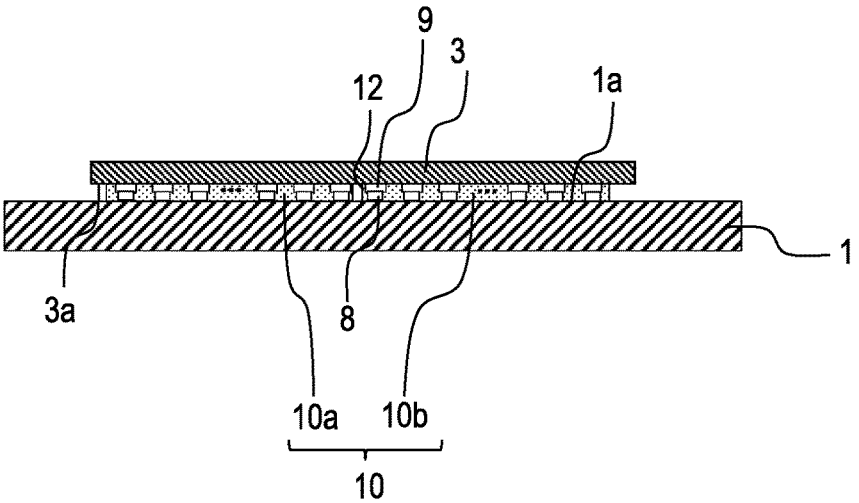
FIG. 7C is a cross-sectional view taken along the line B-B of the portion where the element substrate and the wiring substrate are bonded in the manufacturing method of the liquid ejecting head illustrated in FIGS. 1A and 1B.

The sealing resin 11 is applied to the bonding surface between the wiring substrate 3 and the element substrate 1 illustrated by the arrow in FIG. 7B in the vicinity of the connection portion. As illustrated by the arrow in FIG. 7A, the sealing resin 11 turns around from both end portions of the wiring substrate 3 in the arrangement direction of the electrode terminals 9, and flows from the gap 12 for promoting the sealing resin inflow in the intermediate portion toward both end portion sides. The sealing resin 11 flows through the gap between the wiring substrate 3 and the element substrate 1 by a capillary phenomenon and is filled so as to surround the entire area of the resin layer 10. According to the present example, even when the connection portion between the electrode 7 and the electrode terminal 9 is provided over a wide area, it is possible to uniformly fill the sealing resin 11 in a short time while suppressing the generation of an unfilled portion and taking in the air bubbles.

Example 2

Figure 11A:
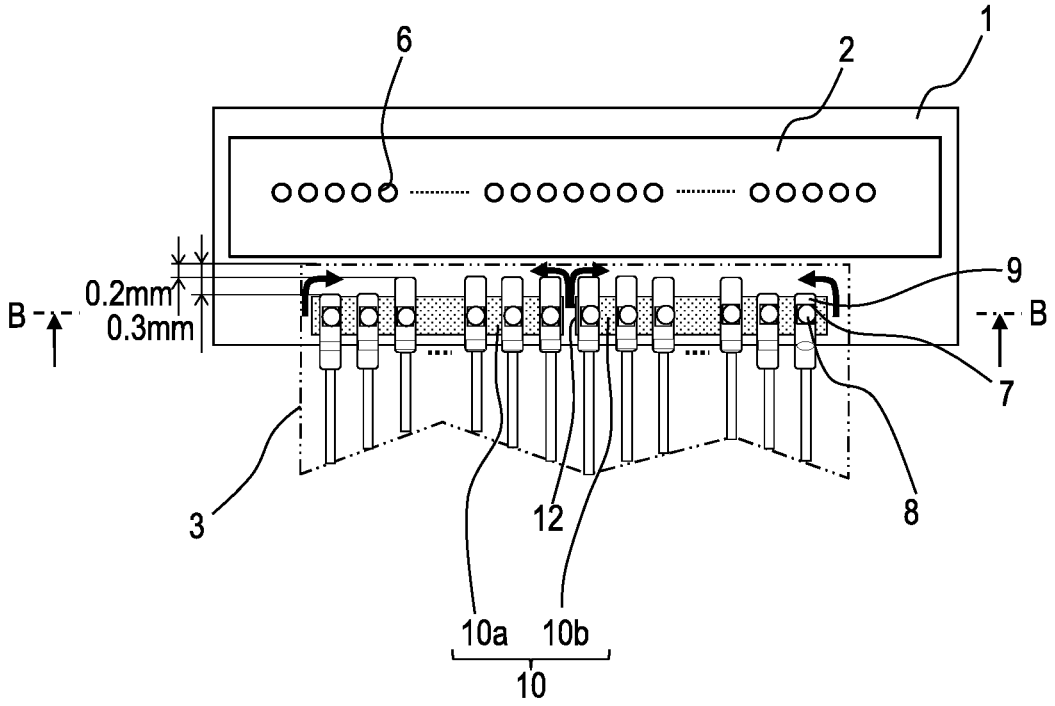
FIG. 11A is a plan view illustrating a wiring substrate in a portion where an element substrate and the wiring substrate are bonded in a liquid ejecting head according to Example 2 of the present invention.
Figure 11B:
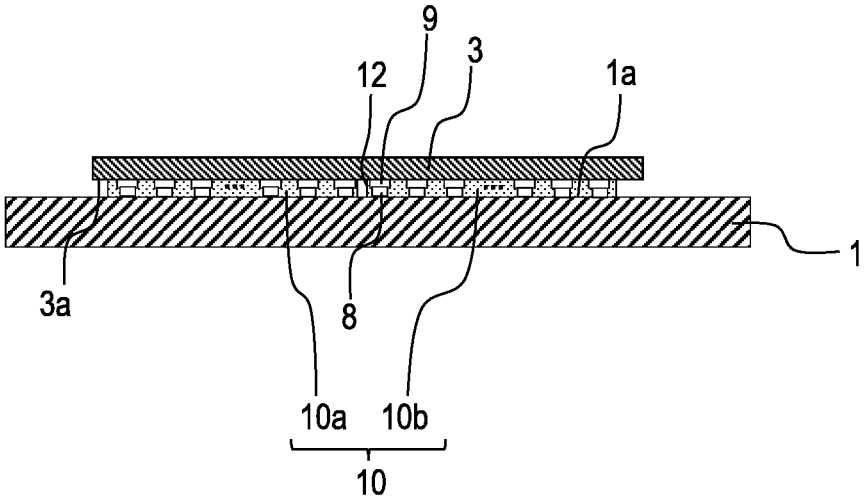
FIG. 11B is a cross-sectional view taken along line B-B of the portion where the element substrate and the wiring substrate are bonded in the liquid ejecting head according to Example 2 of the present invention.

FIG. 11A is a plan view illustrating a wiring substrate 3 illustrated by a two-dot chain line in a portion where an element substrate 1 and the wiring substrate 3 are bonded in a liquid ejecting head according to Example 2 of the present invention. FIG. 11B is a cross-sectional view taken along the line B-B thereof. In the liquid ejecting head according to the present example, at least one (two each in the example illustrated in FIG. 11A) electrode terminal 9 on each of both end sides in the arrangement direction is located at a position further retracted from the end portion of the wiring substrate 3 from the other electrode terminals 9, among the electrode terminals 9 of the wiring substrate 3. The end portion of the wiring substrate 3 referred to here is an end portion on the side close to the ejection orifice forming member 2 in the longitudinal direction of the wiring substrate 3 (direction of the line A-A in FIG. 3A). As an example, the retreat distance of the intermediate portion of the electrode terminal 9 from the end portion of the wiring substrate 3 is 0.2 mm, whereas the retreat distance from the end portion of the electrode terminal 9 further retreated is 0.3 mm, which is larger than the retreat distance of the intermediate portion. Also in the present example, the plurality of electrodes 7 of the element substrate 1 is arranged at positions facing the plurality of electrode terminals 9 of the wiring substrate 3, respectively. Since the electrode terminals 9 on both end sides of the wiring substrate 3 in the arrangement direction of the electrode terminals 9 are further retracted from the other electrode terminals 9 as described above, the capillary force acting on the sealing resin 11 further increases from both end portions of the wiring substrate 3 toward the intermediate portion. As a result, the filling time of the sealing resin 11 is further shortened in combination with an effect of promoting the sealing resin inflow by the gap 12 provided in the resin layer 10 as described above. Furthermore, by retracting a portion of the electrode terminals 9 from the other electrode terminals 9, there is an effect that alignment with the electrodes 7 of the element substrate 1 is easy. It is more desirable that each of five or more electrode terminals 9 on both end sides in the arrangement direction is at a position further retracted from the end portion of the wiring substrate 3 than the other electrode terminals 9, among the electrode terminals 9 of the wiring substrate 3.

Example 3

Figure 12A:
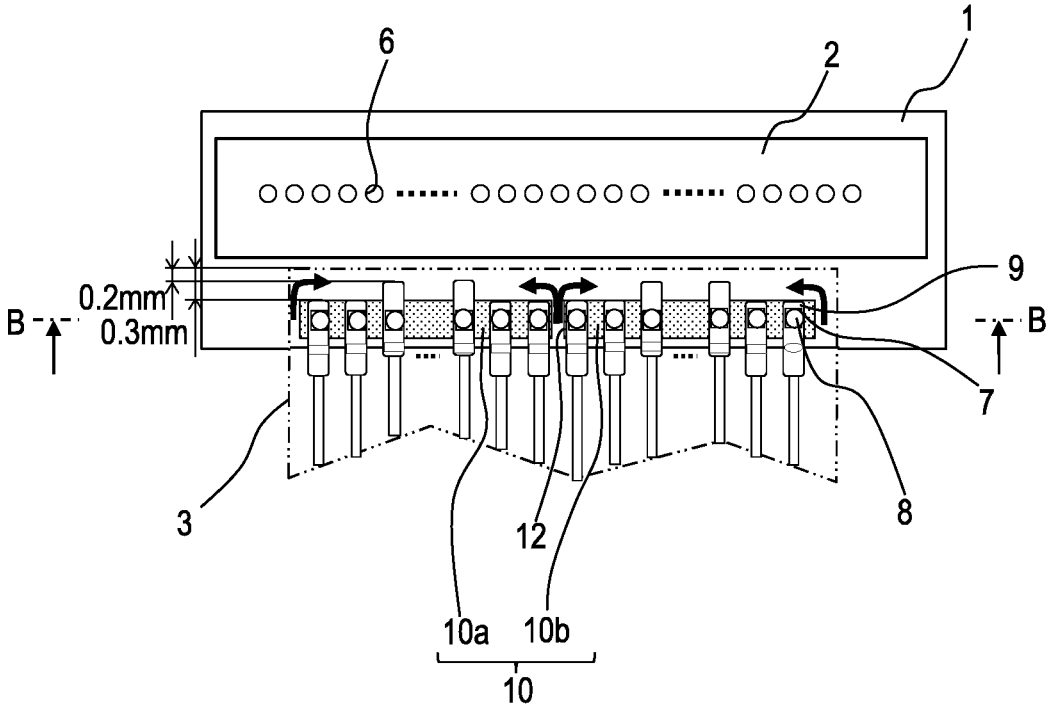
FIG. 12A is a plan view illustrating a wiring substrate in a portion where an element substrate and the wiring substrate are bonded in a liquid ejecting head according to Example 3 of the present invention.
Figure 12B:
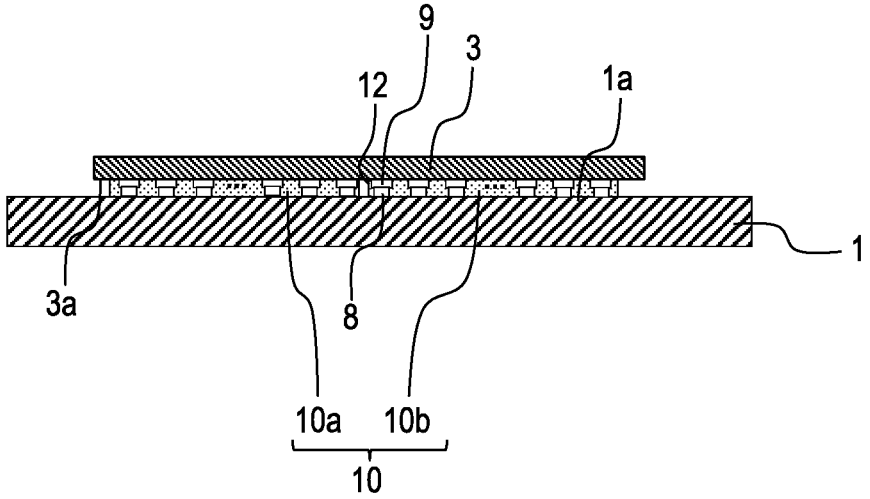
FIG. 12B is a cross-sectional view taken along line B-B of the portion where the element substrate and the wiring substrate are bonded in the liquid ejecting head according to Example 3 of the present invention.

FIG. 12A is a plan view illustrating a wiring substrate 3 illustrated by a two-dot chain line in a portion where an element substrate 1 and the wiring substrate 3 are bonded in a liquid ejecting head according to Example 3 of the present invention. FIG. 12B is a cross-sectional view taken along the line B-B thereof. In the liquid ejecting head according to the present example, the electrode terminals 9 located at positions further retracted from the end portions of the wiring substrate 3 than the other electrode terminals 9 are present on both end sides and the intermediate portion of the wiring substrate 3 in the arrangement direction of the electrode terminals 9. The end portion of the wiring substrate 3 referred to here is an end portion on the side close to the ejection orifice forming member 2 in the longitudinal direction of the wiring substrate 3 (direction of the line A-A in FIG. 3A). That is, similarly to Example 2, at least one and preferably five or more (two each in the example illustrated in FIG. 12A) electrode terminals 9 at each of both end sides in the arrangement direction are further retracted from the end portion of the wiring substrate 3. In addition, at least one and preferably five or more (two each in the example illustrated in FIG. 12A) electrode terminals 9 located on each of both sides of the gap 12 of the resin layer 10 in the intermediate portion are also further retracted from the end portion of the wiring substrate 3. The retreat distance from the other end portion of the electrode terminal 9 is 0.2 mm, whereas the retreat distance from the end portion of the electrode terminal 9 further retracted is 0.3 mm, which is larger than the retreat distance from the other end portion. Also in this configuration, the electrodes 7 of the element substrate 1 are arranged at positions facing each of the electrode terminals 9 of the wiring substrate 3. The same effect as that of Example 2 can be obtained. Furthermore, since the electrode terminals 9 located on both sides of the gap 12 of the resin layer 10 are further retracted, the sealing resin 11 is likely to flow from the gap 12 toward both end portion sides, and an effect of promoting the sealing resin inflow is enhanced.

Example 4

Figure 13A:
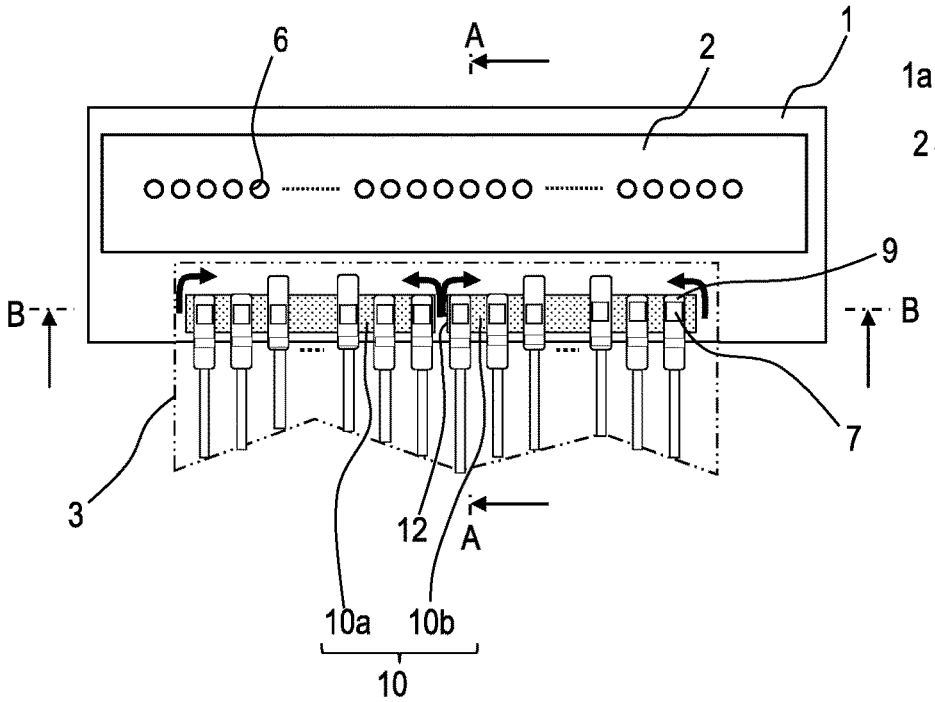
FIG. 13A is a plan view illustrating a wiring substrate in a portion where an element substrate and the wiring substrate are bonded in a liquid ejecting head according to Example 4 of the present invention.
Figure 13B:
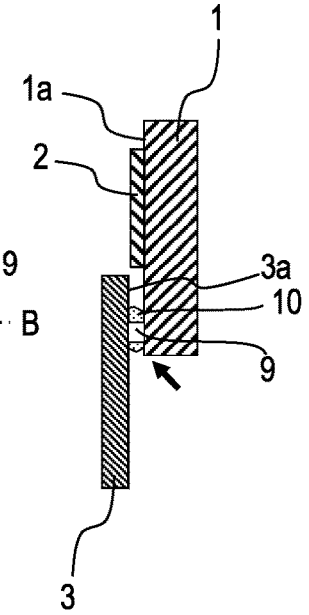
FIG. 13B is a cross-sectional view taken along line A-A of the portion where the element substrate and the wiring substrate are bonded in the liquid ejecting head according to Example 4 of the present invention.
Figure 13C:
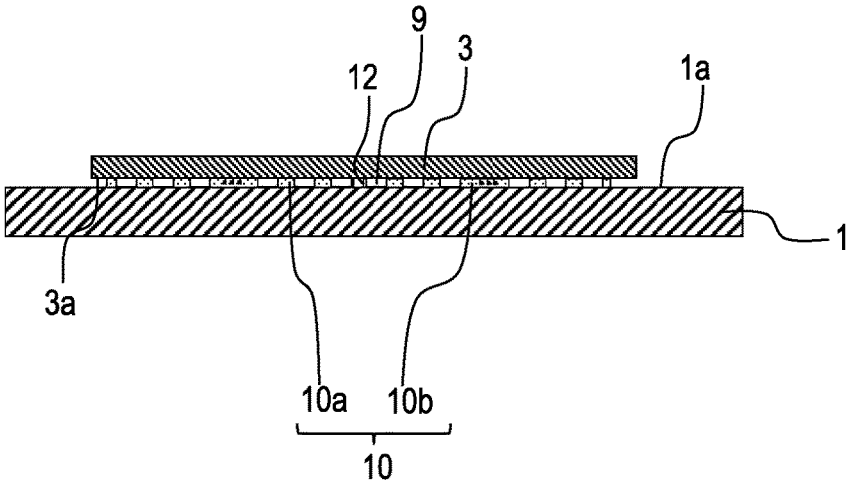
FIG. 13C is a cross-sectional view taken along line B-B of the portion where the element substrate and the wiring substrate are bonded in the liquid ejecting head according to Example 4 of the present invention.
Figure 14A:
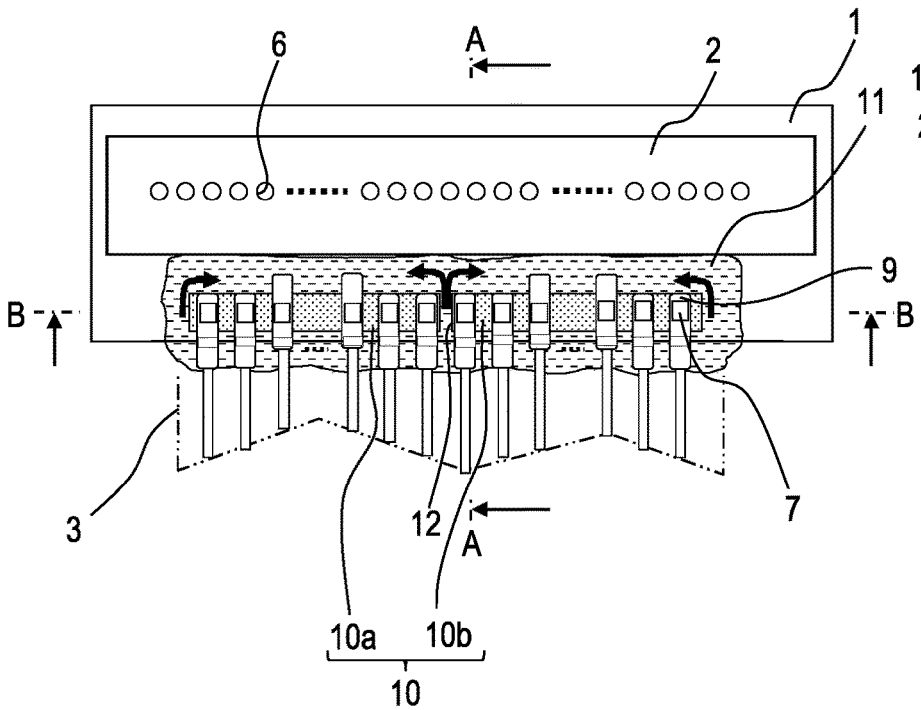
FIG. 14A is a plan view illustrating the wiring substrate in a state where a sealing resin is applied to the liquid ejecting head illustrated in FIGS. 13A and 13B.
Figure 14B:
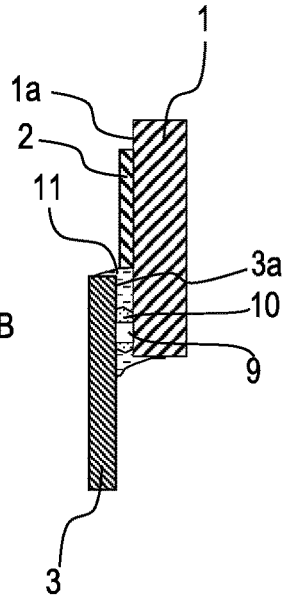
FIG. 14B is a cross-sectional view taken along the line A-A of the state where the sealing resin is applied to the liquid ejecting head illustrated in FIGS. 13A and 13B.
Figure 14C:
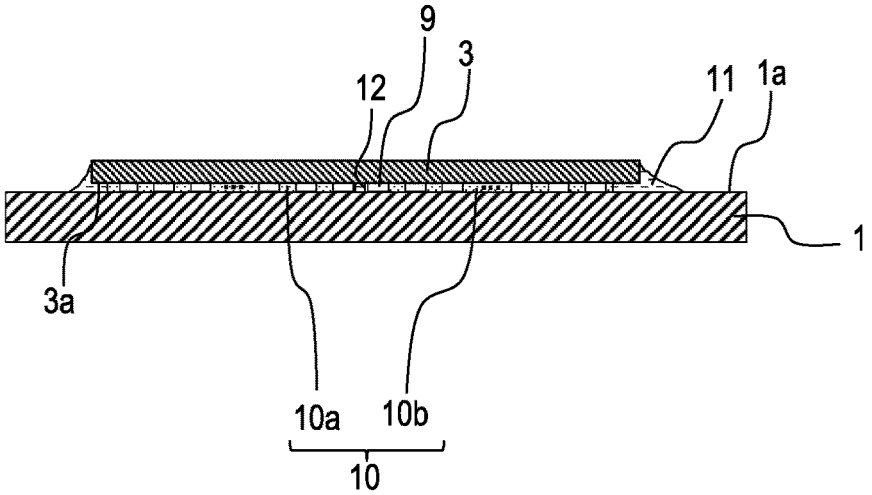
FIG. 14C is a cross-sectional view taken along the line B-B of the state where the sealing resin is applied to the liquid ejecting head illustrated in FIGS. 13A and 13B.

FIG. 13A is a plan view illustrating a perspective view of a wiring substrate 3 illustrated by a two-dot chain line before a sealing resin is applied to a portion where an element substrate 1 and the wiring substrate 3 are bonded in a liquid ejecting head according to Example 4 of the present invention. FIG. 13B is a cross-sectional view taken along the line A-A thereof, and FIG. 13C is a cross-sectional view taken along the line B-B. FIG. 14A is a plan view illustrating a perspective view of the wiring substrate 3 illustrated by a two-dot chain line after the sealing resin is applied to the portion where the element substrate 1 and the wiring substrate 3 are bonded in a liquid ejecting head in FIG. 13A. FIG. 14B is a cross-sectional view taken along the line A-A thereof, and FIG. 14C is a cross-sectional view taken along the line B-B. In the liquid ejecting head according to the present example, similarly to Example 3, there are the electrode terminals 9 further retracted from the end portion of the wiring substrate 3 as compared with the other electrode terminals 9 on both end sides in the arrangement direction and on both sides of the gap 12 of the resin layer 10. The end portion of the wiring substrate 3 referred to here is an end portion on the side close to the ejection orifice forming member 2 in the longitudinal direction of the wiring substrate 3 (direction of the line A-A in FIG. 3A). Each of the retreat distances is 0.2 mm and 0.3 mm. The electrode terminal 9 of the wiring substrate 3 and the electrode 7 of the element substrate 1 are connected to each other by using ACF as the resin layer 10. Prior to bonding the wiring substrate 3 and the element substrate 1, the AFC is temporarily pressure-bonded to the position where the electrode terminals 9 of the wiring substrate 3 are formed. At this time, the ACF is able to be accurately attached to the electrode terminals 9 further retracted on both end portions in the arrangement direction and on both sides of the gap 12 as guides for alignment. As a result, the gap 12 is able to be reliably ensured. Thereafter, the electrode terminals 9 of the wiring substrate 3 and the electrodes 7 of the element substrate 1 are aligned with each other, heated and pressed to complete the bonding of the two substrates 1 and 3. As illustrated in FIG. 13C, in the bonding using the ACF, the electrode 7 and the electrode terminal 9 are in direct contact with each other, and an interval between the element substrate 1 and the wiring substrate 3 after the bonding is approximately 30 μm, which is narrower than that of the bonding using the bump 8 and one of the NCF and NCP. However, since the ACF is able to be accurately aligned by using the retracted electrode terminal 9, there is a great effect that it is easy to reliably ensure the flow path of the sealing resin 11. Also in the present example, the sealing resin 11 smoothly flows from both end portions in the arrangement direction and the gap 12 in the intermediate portion, and the effect of further shortening the filling time of the sealing resin 11 can be obtained.

Example 5

Figure 15A:
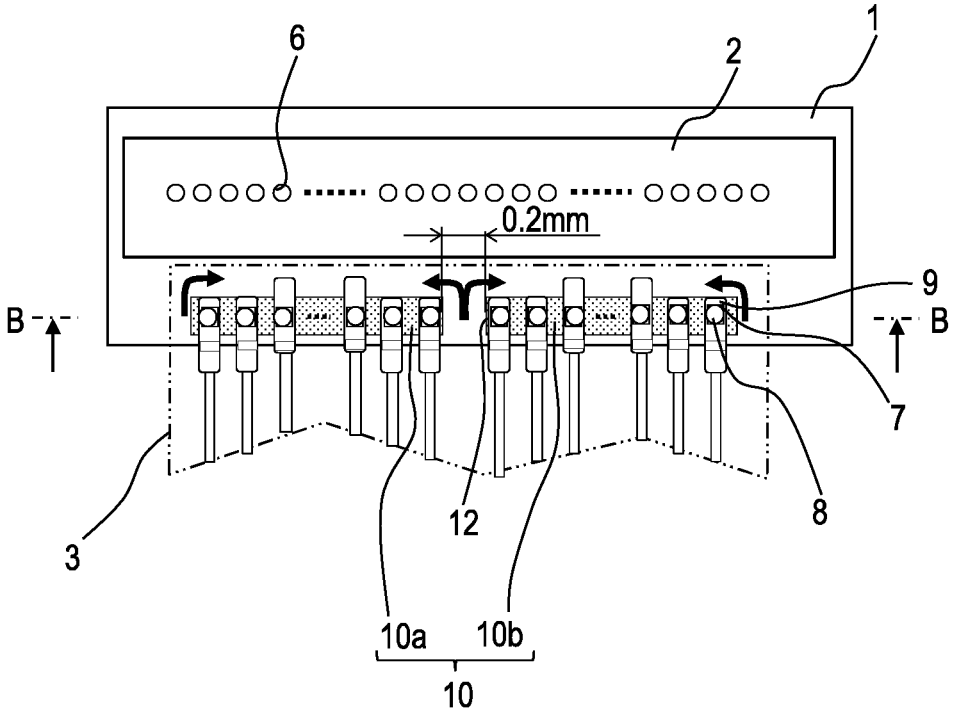
FIG. 15A is a plan view illustrating a wiring substrate in a portion where an element substrate and the wiring substrate are bonded in a liquid ejecting head according to Example 5 of the present invention.
Figure 15B:
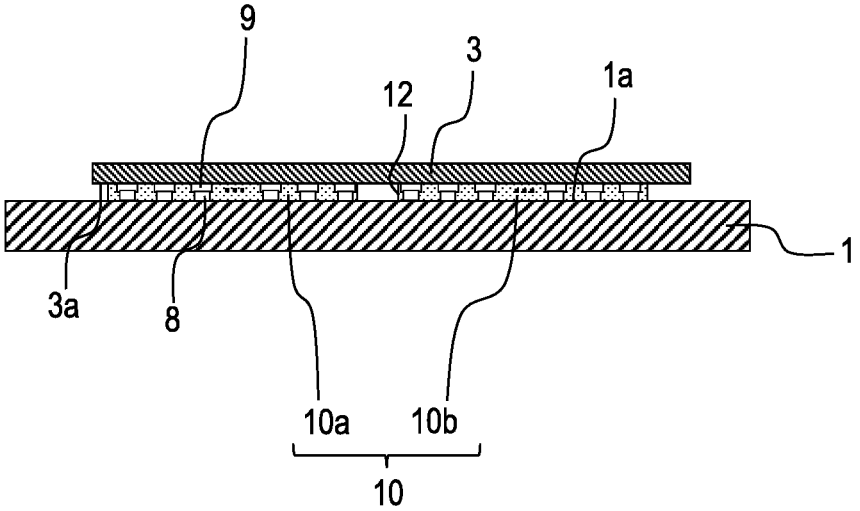
FIG. 15B is a cross-sectional view taken along the line B-B of a portion where the element substrate and the wiring substrate are bonded in the liquid ejecting head according to Example 5 of the present invention.

FIG. 15A is a plan view illustrating a wiring substrate 3 illustrated by a two-dot chain line before a sealing resin is applied to a portion where an element substrate 1 and the wiring substrate 3 are bonded in a liquid ejecting head according to Example 5 of the present invention. FIG. 15B is a cross-sectional view taken along the line B-B thereof. In the liquid ejecting head according to the present example, similarly to Example 3, there are the electrode terminals 9 further retracted from the end portion of the wiring substrate 3 as compared with the other electrode terminals 9 on both end sides in the arrangement direction and on both sides of the gap 12 of the resin layer 10. The end portion of the wiring substrate 3 referred to here is an end portion on the side close to the ejection orifice forming member 2 in the longitudinal direction of the wiring substrate 3 (direction of the line A-A in FIG. 3A). In the present example, the electrode terminals 9 located on both sides of the gap 12 of the resin layer 10 are located at large intervals along the arrangement direction. In Example 3, the pitch of the plurality of electrode terminals 9 in a row including the gap 12 of the resin layer 10 and the position facing the periphery thereof is not changed. However, in the present example, the electrode terminals 9 are arranged at positions facing the gap 12 with a pitch (for example, 0.2 mm) twice that of the other. Also in the present example, after the NCF, which is the resin layer 10 divided into the two portions 10*a* and 10*b* by the gap, is temporarily pressure-bonded to the wiring substrate 3, the electrodes 7 of the element substrate 1 and the electrode terminals 9 of the wiring substrate 3 are aligned, heated and pressed to bond both substrates 1 and 3. In the present example, since a wide interval is ensured at a position facing the gap 12 of the resin layer 10, even in bonding using the ACF having a narrow gap between the element substrate 1 and the wiring substrate 3 as the resin layer 10, the sealing resin 11 having a relatively high viscosity is able to be used. For example, in the present example, the width of the gap 12 of the resin layer 10 after heating and pressing is ensured at 0.1 mm. With this configuration, it is possible to satisfactorily fill the sealing resin (CV5420AR (trade name) manufactured by Panasonic Corporation) having a viscosity of 30 Pa·sec.

Combination of Each Example

As in each of the above-described examples of the present invention, by combining the position of the electrode terminal 9 of the wiring substrate 3 and the type (NCF, NCP and ACF) and the position of the resin layer 10 used for bonding, it is possible to select and use the sealing resin 11 that is optimal for each configuration.

The number of divisions of the resin layer 10 in the present invention may be three or more. In that case, two or more gaps 12 are provided in the resin layer 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-173878, filed Sep. 25, 2019, which is hereby incorporated by reference herein in its entirety.

What is claimed is:

1. A liquid ejecting head comprising:

an element substrate that includes a plurality of energy generating elements generating energy for ejecting a liquid, and a plurality of electrodes connected to the plurality of energy generating elements; and a wiring substrate that includes a plurality of electrode terminals connected to the plurality of electrodes, wherein the plurality of electrodes and the plurality of electrode terminals are arranged side by side in a row, respectively, the element substrate and the wiring substrate are overlapped with each other in a state where each of the electrodes and the corresponding electrode terminals face each other, a connection portion to which the plurality of electrodes and the plurality of electrode terminals are connected is surrounded by a resin layer, and the resin layer is covered with a sealing resin, the resin layer is divided into a plurality of portions by a gap provided in a portion between both end portions in an arrangement direction of the electrode terminals, an inside of the gap of the resin layer is filled with the sealing resin, and at least one of the plurality of electrode terminals has a retreat distance from an end portion of the wiring substrate that is longer than that of the other electrode terminals.

2. The liquid ejecting head according to claim 1, further comprising:

an ejection orifice forming member that is disposed at a position on the element substrate, which does not overlap the wiring substrate, and that includes ejection orifices from which a liquid to which energy is applied from the energy generating elements is ejected.

3. The liquid ejecting head according to claim 1, wherein at least one electrode terminal located at each of both end portions in the arrangement direction of the electrode terminals is an electrode terminal having the longer retreat distance from the end portion of the wiring substrate.

4. The liquid ejecting head according to claim 1, wherein at least one electrode terminal located at each of both side portions of the gap in the arrangement direction of the electrode terminals is an electrode terminal having the longer retreat distance from the end portion of the wiring substrate.

5. A liquid ejecting head comprising:

an element substrate that includes a plurality of energy generating elements generating energy for ejecting a liquid, and a plurality of electrodes connected to the plurality of energy generating elements; and a wiring substrate that includes a plurality of electrode terminals connected to the plurality of electrodes, wherein the plurality of electrodes and the plurality of electrode terminals are arranged side by side in a row, respectively, the element substrate and the wiring substrate are overlapped with each other in a state where each of the electrodes and the corresponding electrode terminals face each other, a connection portion to which the plurality of electrodes and the plurality of electrode terminals are connected is surrounded by a resin layer, and the resin layer is covered with a sealing resin, the resin layer is divided into a plurality of portions by a gap provided in a portion between both end portions in an arrangement direction of the electrode terminals, an inside of the gap of the resin layer is filled with the sealing resin, and a pitch of the electrode terminals adjacent to each other with a position facing the gap interposed therebetween is greater than a pitch of the other electrode terminals, among the plurality of electrode terminals.

6. A liquid ejecting head comprising:

an element substrate that includes a plurality of energy generating elements generating energy for ejecting a liquid, and a plurality of electrodes connected to the plurality of energy generating elements; and a wiring substrate that includes a plurality of electrode terminals connected to the plurality of electrodes, wherein the plurality of electrodes and the plurality of electrode terminals are arranged side by side in a row, respectively, the element substrate and the wiring substrate are overlapped with each other in a state where each of the electrodes and the corresponding electrode terminals face each other, a connection portion to which the plurality of electrodes and the plurality of electrode terminals are connected is surrounded by a resin layer, and the resin layer is covered with a sealing resin, the resin layer is divided into a plurality of portions by a gap provided in a portion between both end portions in an arrangement direction of the electrode terminals, an inside of the gap of the resin layer is filled with the sealing resin, and each of the electrodes and the corresponding electrode terminals face each other via a bump, and the resin layer is made of one of a non-conductive resin film and a non-conductive resin paste.

7. A liquid ejecting head comprising:

an element substrate that includes a plurality of energy generating elements generating energy for ejecting a liquid, and a plurality of electrodes connected to the plurality of energy generating elements; and a wiring substrate that includes a plurality of electrode terminals connected to the plurality of electrodes, wherein the plurality of electrodes and the plurality of electrode terminals are arranged side by side in a row, respectively, the element substrate and the wiring substrate are overlapped with each other in a state where each of the electrodes and the corresponding electrode terminals face each other, a connection portion to which the plurality of electrodes and the plurality of electrode terminals are connected is surrounded by a resin layer, and the resin layer is covered with a sealing resin, the resin layer is divided into a plurality of portions by a gap provided in a portion between both end portions in an arrangement direction of the electrode terminals, an inside of the gap of the resin layer is filled with the sealing resin, and each of the electrodes and the corresponding electrode terminals are in direct contact with each other, and the resin layer is made of an anisotropic conductive resin film.

* * * * *